US007170238B2

(12) United States Patent
Adamson et al.

(10) Patent No.: US 7,170,238 B2
(45) Date of Patent: Jan. 30, 2007

(54) CONTROL SYSTEMS AND METHODS

(75) Inventors: Hugh P. Adamson, Boulder, CO (US); Scott Hesse, Longmont, CO (US)

(73) Assignee: Colorado vNet, LLC, Loveland, CO (US)

( * ) Notice: Subject to any disclaimer, the term of this patent is extended or adjusted under 35 U.S.C. 154(b) by 539 days.

(21) Appl. No.: 10/631,387

(22) Filed: Jul. 30, 2003

(65) Prior Publication Data

US 2005/0023996 A1 Feb. 3, 2005

(51) Int. Cl.
*H05B 37/00* (2006.01)

(52) U.S. Cl. ..... 315/293; 315/316

(58) Field of Classification Search ..... 315/293, 315/316, 317

See application file for complete search history.

(56) References Cited

U.S. PATENT DOCUMENTS

| | | | | |
|---|---|---|---|---|
| 4,213,182 | A * | 7/1980 | Eichelberger et al. | 700/296 |
| 4,656,398 | A * | 4/1987 | Michael et al. | 315/293 |
| 5,289,496 | A | 2/1994 | Nakagawa et al. | |
| 5,675,221 | A | 10/1997 | Yoo et al. | |
| 5,751,118 | A | 5/1998 | Mortimer | |
| 6,020,825 | A | 2/2000 | Chansky et al. | |
| 6,310,440 | B1 | 10/2001 | Lansing et al. | |
| 6,424,099 | B1 | 7/2002 | Kirkpatrick et al. | |
| 6,486,617 | B2 | 11/2002 | Pilz et al. | |
| 6,498,837 | B1 | 12/2002 | Baba | |
| 6,534,931 | B1 | 3/2003 | Konopka et al. | |
| 6,557,062 | B1 | 4/2003 | Shaler et al. | |

FOREIGN PATENT DOCUMENTS

JP 60-254166 * 12/1985

OTHER PUBLICATIONS

"Introducing the Next Generation of Home Control Systems", 4 pgs, Advanced Control Technologies, Inc., Indianapolis, IN. Available at www.act-solutions.com at least Jul. 2004.

Internet Presentation, "Zwave: the wireless language", 18 pgs. Available at www.act-solutions.com at least Jul. 2004.

* cited by examiner

*Primary Examiner*—David Vu
(74) *Attorney, Agent, or Firm*—Trenner Law Firm, LLC

(57) ABSTRACT

Control systems and methods. An embodiment of control system may comprise a processor for receiving control signals from at least one input device when linked thereto. Computer-readable program code is provided for generating output signals at the processor based on the control signals. An interface is operatively associated with the processor, the interface configures at least one regulator based on the output signals generated at the processor by delivering pulse width modulated signals to the at least one regulator.

28 Claims, 3 Drawing Sheets

CONTROL SYSTEMS AND METHODS

FIELD OF THE INVENTION

The invention pertains generally to electronic regulators and more specifically to control systems and methods for use with electronic regulators.

BACKGROUND OF THE INVENTION

Artificial lighting in industrial countries currently consumes 27% to 40% of the electricity budget for both commercial and residential users. As a result, new ways are being sought to reduce energy consumption associated with artificial lighting. One way of reducing energy consumption is to control the lighting based on time of day, usage patterns, by agreement with the utility company, etc. Controlling artificial lighting for other reasons (e.g., architectural emphasis, security, emergency situations, visual acuity, or scene illumination) is also becoming more commonplace and may be controlled based on one or more parameters (e.g., time, user preference).

Inexpensive dimmer switches are available which may be directly connected to one or more lights for controlling the luminance level or lighting intensity output by the lights. However, these switches are typically manually operable and therefore are not effective for scene control, energy savings, or more sophisticated uses (e.g., periodic or demand-based changes) on a regular basis. In addition, these dimmer switches are typically not compatible with gas discharge lighting (e.g., fluorescent lights).

A variety of electronic regulators are commercially available for controlling the output of various types of loads. For example, lighting regulators or electronic ballasts are available for regulating the illumination level of gas-discharge lighting. Lighting regulators are typically used with sophisticated computer systems and operating software that is programmed in advance to issue luminance levels for the gas-discharge lights on a predetermined schedule. Accordingly, use is typically limited to large industrial settings where the energy savings offsets the cost of such a system.

SUMMARY OF THE INVENTION

An embodiment of control system may comprise a processor for receiving control signals from at least one input device when linked thereto. Computer-readable program code may be provided at the processor for generating output signals at the processor based on the control signals. An interface may be operatively associated with the processor, the interface configuring at least one regulator based on the output signals generated at the processor.

A method for controlling at least one regulator may comprise: receiving control signals at a processor; generating output signals at the processor based on the control signals; and configuring the at least one regulator based on the output signals.

BRIEF DESCRIPTION OF THE DRAWINGS

Illustrative and presently preferred embodiments of the invention are shown in the drawings, in which.

DESCRIPTION OF THE PREFERRED EMBODIMENT

Figure 1:
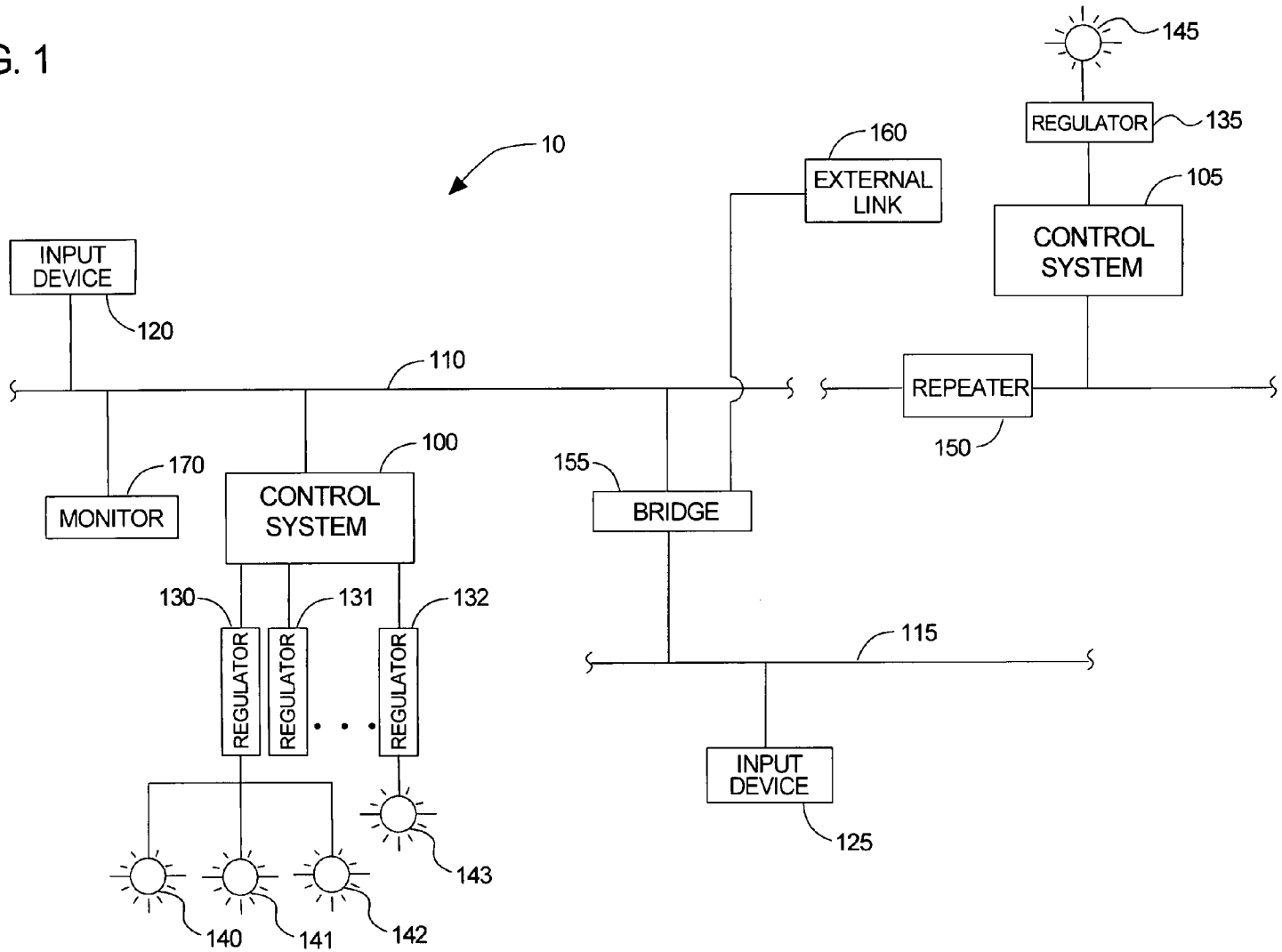
FIG. 1 is a high-level diagram illustrating one environment in which control system of the present invention may be used.

Control system 100 is shown and described herein as it may be used in a building automation environment 10, such as the one shown in FIG. 1. The building automation environment 10 may be implemented in any of a number of different types of buildings, such as residences, offices, restaurants, stores, theaters, hotels; and/or grounds such as stadiums, parks, parking lots, and freight yards, to name only a few. Other uses for control system 100 are also contemplated as being within the scope of the invention, as will become readily apparent to one skilled in the art after having become familiar with the teachings of the invention.

In one embodiment of the invention, control system 100 may be linked via network 110 to one or more devices on the network 110. Preferably, at least one of these devices is a control device or input device 120, such as a keypad. Of course any number of control systems 100 and devices may be provided in the building automation environment 10. Likewise, input device 120 may issue control signals to more than one of the electrical systems 100 either simultaneously (e.g., via broadcast) or independently (e.g., via point-to-point link). Additional control systems 105 and input devices 125 are shown in FIG. 1 for purposes of illustration.

Control system 100 may be operatively associated with one or more regulators 130. Although the discussion herein is primarily with reference to regulator 130, additional regulators 131, 132, and 135 are also shown in FIG. 1 for purposes of illustration. Regulator 130 is in turn operatively associated with one or more loads 140. In one embodiment, control system 100 may have eight legs, each leg able to operate five hundred regulators 130. Accordingly, control system 100 can operate four thousand (i.e., 5×8=4000) loads. However, the invention is not limited to any particular number and can be used to control more or less loads. Loads 141, 142, 143, and 145 are also shown in FIG. 1 for purposes of illustration. It is understood, however, that the invention is not limited in scope to any particular configuration.

Although the invention is illustrated herein where regulator 130 is an electronic ballast and load 140 is a gas-discharge light, it is understood that control system 100 may also be modified for use with other types of regulators 130 and loads 140. In another exemplary embodiment, regulator 130 may be an electrically-controlled regulator for electrical motors and load 140 may be a DC motor for applications, such as, but not limited to lowering a screen, moving drapery, or rotating a ceiling fan. Yet other uses will also become apparent to those skilled in the art after understanding the teachings of the present invention.

Figure 2:
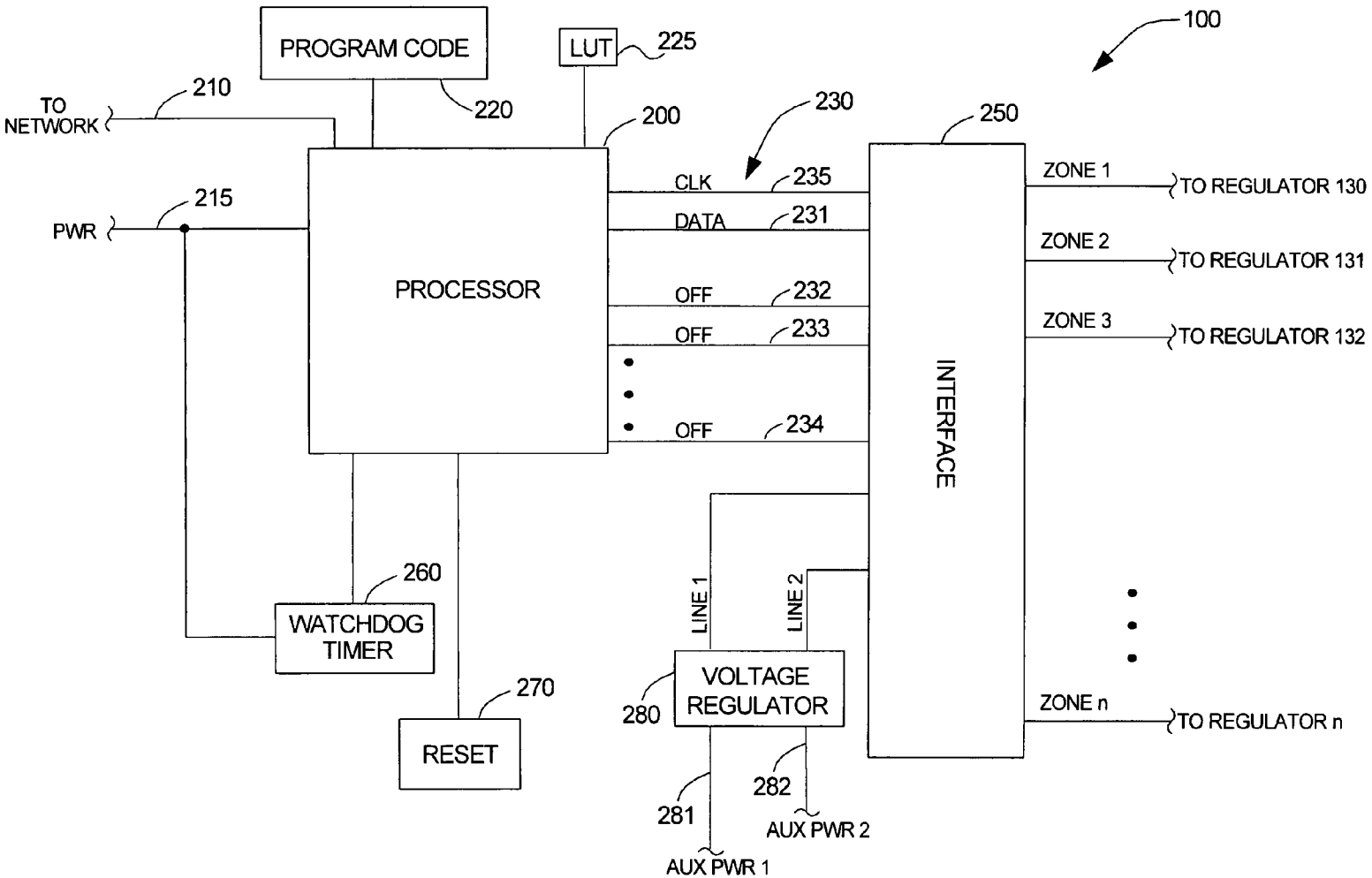
FIG. 2 is a functional diagram showing one embodiment of the control system.

An embodiment of control system 100 is shown in more detail in FIG. 2 and may comprise a processor 200 for receiving control signals (e.g., over line 210) from at least one of the input devices 120 on the network 110. Computer-readable program code 220 may be provided at the processor 200 for generating a data stream or output signals 230 based on the control signals it receives. An interface 250 may be operatively associated with the processor 200 for configuring at least one of the regulators 130 based on the output signals 230, which in turn control lighting in the building automation environment 10.

Briefly, control system 100 may be operated according to one embodiment of the invention to control at least one of the regulators 130 as follows. An event at the input device 120 (e.g., a user pressing a button on a keypad, a timer) causes the input device 120 to generate control signal(s) corresponding to the event. For example, the control signals may correspond to a desired illumination level for the lighting in a room. These control signals are sent over network 110 and are received at the control system 100.

The control signals may be received at control system 100 and delivered to the processor 200 (e.g., over line 210). For example, where the network 110 comprises a CAN bus, the control signals are delivered as CAN signals, which may be converted to TTL signals and delivered over line 210 to the processor 200. The processor 200 executes program code 220 to generate output signals 230 based on these control signals. For example, the processor 200 may execute at least one script which defines the output signals 230 corresponding to various control signals. The output signals 230 are delivered via the interface 250 to at least one of the regulators 130 to control the lighting (e.g., by adjusting the illumination level of lights 140).

Advantageously, the control system 100 of the present invention may also be used with legacy devices and/or legacy systems. For example, in commercially available PC-based controlled light systems, the PC operates a single control loop. The PC can be removed and the control lines broken and connected with the control system 100 of the present invention.

The flexibility of the control system 100 also allows for a variety of control schemes to be implemented. By way of example, a residence may use the control system 100 for scene control (e.g., changing the lighting in a great room from a party atmosphere to a showing of the art on the walls). An apartment building may use control system 100 for remote control and feedback (e.g., via a photo sensor) of the security lighting on the grounds. A multistory commercial building may use control system 100 to respond to a remote request from the utility company to lower the energy consumption (e.g., during peak usage or during a brownout).

Having briefly described control system and use thereof according to an embodiment of the invention, as well as some of the more significant features and advantages thereof, embodiments of the control system will now be described in detail.

As mentioned above, control system 100 may be linked via network 110 to one or more input devices 120 in building automation environment 10 such as the one shown in FIG. 1. Network 110 may also be extended, for example, using a repeater 150.

Input device 120 may be any suitable device for issuing a control signal to at least another device on one or more of the networks (e.g., 110, 115). For example, input device 120 may be keypads, keyboards, graphical user interfaces (GUI), personal computers (PC), remote input devices, security sensors, temperature sensors, light sensors, and timers.

Various types of networks 110 may be provided according to the teachings of the invention. In one embodiment, network 110 comprises a controller area network (CAN) bus. Such a network for use in a building automation environment is described in more detail in co-pending, co-owned U.S. patent application Ser. No. 10/382,979, entitled "BUILDING AUTOMATION SYSTEM AND METHOD" of Hesse, et al., filed on Mar. 5, 2003, which is hereby incorporated herein by reference for all that it discloses.

Briefly, the CAN bus comprises a two-wire differential serial data bus. The CAN bus is capable of high-speed data transmission (about 1 Megabits per second (Mbits/s)) over a distance of about 40 meters (m), and can be extended to about 10,000 meters at transmission speeds of about 5 kilobits per second (kbits/s). It is also a robust bus and can be operated in noisy electrical environments while maintaining the integrity of the data.

The CAN specification is currently available as version 1.0 and 2.0 and is published by the International Standards Organization (ISO) as standards 11898 (high-speed) and 11519 (low-speed). The CAN specification defines communication services and protocols for the CAN bus, in particular, the physical layer and the data link layer for communication over the CAN bus. Bus arbitration and error management is also described. Of course the invention is not limited to any particular version and it is intended that other specifications for the CAN bus now known or later developed are also contemplated as being within the scope of the invention.

It is understood, however, that the present invention is not limited to use with the CAN bus and other types and/or configurations of networks are also contemplated as being within the scope of the invention. Other networks may also comprise an Ethernet or a wireless network (e.g., radio frequency (RF), BLUETOOTH™), to name only a few.

In addition, the network 110 may comprise more than one network (e.g., 115), or subnets as they are sometimes referred to. By way of example, control system 100 may be used with existing lighting controller networks (e.g., LON WORKS or CE Bus). In another embodiment, for example, the network may comprise a plurality of CAN bus subnets, each linked to one another by an Ethernet network. Bridging apparatus 155 may be provided to link the subnets to one another. Preferably devices on other networks (e.g., 115) can be operated to issue control signals to control system 100.

It is understood that control system 100 may be operatively associated with the network 110 in any suitable manner, including by permanent, removable, or remote link. By way of example, control system 100 may be permanently linked to the network 110 by a hard-wire connection. Alternativley, control system 100 may be removably linked to the network 110 by a "plug-type" connection. Control system 100 may also be remotely linked to the network 110, for example via an RF link. Suitable network interfaces may be provided between control system 100 and the network 110 for issuing and receiving signals via the network 110. For example, in one embodiment the network interface converts between Transistor Transistor Logic (TTL) signals for use by the device and CAN signals for transmission over the CAN bus. Such network interfaces can be readily provided by one skilled in the art after having become familiar with the teachings of the present invention.

Before continuing, it should be noted that the network 110 may be provided with an optional link 160. Link 160 enables the control system 100 to be linked with other devices and/or systems, allowing the lights 140 to be controlled externally from the network 110. For example, outside security lighting at a residence may be controlled remotely by a homeowner using a thin-film transistor (TFT) display via an Ethernet network (e.g., 115) in the living room, or warehouse lighting may be controlled via a web page on the Internet by the utility company.

In one embodiment, link 160 may comprise an external link from another network such as the Internet through an Internet service provider (ISP). In another embodiment, link 160 may comprise a link at another device on the same network (e.g., bridge 155 or server computer). Link 160 may be used to access control 110 during installation or to configure or reconfigure one or more of the controls 110 at a later time (e.g., remotely).

Of course, it is understood that the link 160 is not limited to an ISP link. In other embodiments, the link 160 may be via a local area network (LAN), a wide area network (WAN), an Intranet, a telephony link, a digital subscriber line (DSL), T-1 connection, cellular link, satellite link, etc. In addition, link 160 may connect to any suitable external device, such as to a laptop computer, personal digital assistant (PDA), pager, facsimile machine, or mobile phone, to name only a few. In addition, link 160 may comprise a temporary connection for use by a service technician or the user. For example, the link 160 may comprise a link for connecting a laptop computer to the network 110.

In addition, other devices may be provided on the network 110. These devices may be input devices, controlled devices, or combination control/controlled devices, and may operate in conjunction with control system 100 or independently thereof. By way of example, a monitor 170 is shown FIG. 1. In one embodiment, monitor 170 may be a photodetector that may be used to measure the lighting intensity of lights 140. Monitor 170 may provide feedback to the control system 100 so that the lights 140 may be adjusted based on the actual illumination (e.g., of lights 140 and/or other light sources).

The foregoing description is provided in order to better understand one environment in which the control system 100 of the present invention may be used. However, it should be understood that the control system 100 of the present invention may be used in a wide variety of building automation environments 10 and in conjunction with any of a wide range of other types and configurations of networks 110, now known or that may be developed in the future.

Control system 100 may be operatively associated with one or more regulators 130 linked to one or more lights 140. Regulators 130 are commercially available from a variety of manufacturers. For example, regulators 130 may comprise the F32T8 two-lamp regulators available from Easylite Ballasts and Controls, Inc. (Boulder, Colo. 80301) and Osram Sylvania (Danvers, Mass. 01923). Other regulators are also readily commercially available from these manufacturers and from other manufacturers.

Regulators 130 may be operatively associated with a variety of different types of lights 140. For example, lights 140 may comprise high and/or low pressure gas discharge lamps. In one embodiment, lights 140 may comprise high-intensity discharge (HID) lighting, such as the lighting commonly used in sports arenas and stadiums, and more recently on high-end automobiles. HID lighting may comprise a sealed bulb filled with a gas, such as Xenon. In operation, an electrical arc is generated between electrodes in the sealed bulb which ignites the gas. The gas burns bright and at a high color temperature producing a bluish white light. However, the control system 100 is not limited to use with any particular type of lighting, and the invention may also be used with a combination of different types of lights 140.

Before continuing, it should be noted that electrical power may be provided to the control system 100 according to any of a number of embodiments, including combinations thereof. In one embodiment, electrical power may be provided by a primary power source (e.g., via line 215). Primary power source may receive power from a dedicated power delivery system for devices on the network 110. Dedicated power delivery system may be independent of the power delivery system for providing electrical power to the regulators 130 and/or lights 140. Accordingly, control system 100 may be operated even when there is no electrical power being provided to the regulators 130 and/or lights 140.

In another embodiment, electrical power may be provided by one or more auxiliary power sources (e.g., via voltage regulator 280 in FIG. 2). Auxiliary power supplies may receive power from an independent power source, from the regulators 130 and/or lights 140, or other source provided in addition to the primary power source, and provided to control system 100.

By way of example, auxiliary power 281 may be a 12 volt source provided for an electronics cabinet. As another example, auxiliary power 282 may be a 17 volt signal provided from the regulator 130, as will be described in more detail below with regard to FIG. 3. Voltage regulator 280 may output electrical power at desired voltage levels (e.g., +5 volts, +12 volts) as illustrated by Line 1 and Line 2 from the regulator 280 to interface 250 in FIG. 2.

Providing auxiliary power for control system 100 is advantageous, for example, where the user has negotiated power-use agreements with the utility company. Such agreements typically require that the user does not exceed a power usage threshold for predetermined times. Accordingly, lights at the user's facilities are maintained at the present level during these times.

If electrical power to the control system 100 fails or is removed without the auxiliary power supply, the control system 100 may no longer be able to maintain the configuration regulator 130. The lights may turn on at full power (e.g., 100% lighting intensity), causing the user to violate power-use agreements with the utility company. This situation may be avoided by providing auxiliary power to control system 100 so that the configuration of regulator 130 can be maintained even if the main power supply fails. One embodiment for providing electrical power to the control system 100 during a failure of the main power supply is described in more detail below with regard to the circuitry for interface 250 shown in FIG. 3.

Of course the invention is not limited in scope by any particular configuration for providing electrical power to the control system 100. In other exemplary embodiments, electrical power may be provided at an internal power source (e.g., a battery) or other backup or uninterruptible power supply (UPS), such as when the power fails or drops to an unacceptable level. Alternatively, the processor 200 may be powered by the same electrical power source that is used for the lights 140, such as the building's electrical wiring system.

Referring again to FIG. 2, the embodiment of control system 100 shown in FIG. 2 may comprise a processor 200 operatively associated with an interface 250. Interface 250 may be linked to the regulator(s) 130, which in turn control the lights 140 (FIG. 1).

Processor 200 may comprise any conventionally available or later developed microprocessor. By way of example, processor 200 may comprise a PIC® microcontroller available from Microchip Technology, Inc. (Chandler, Ariz. 85224). Other suitable processors may comprise programmable logic devices such as field programmable gate arrays (FPGA) or application-specific integrated circuits (ASIC), to name only a few.

Control system 100 may also comprise a watchdog timer 260 operatively associated with the processor 200. Watchdog timer 260 may be provided to indicate the status of the processor 200 to a user. For example, watchdog timer 260 may light LEDs to indicate the status of processor 200 (e.g., Blue=No Problems; Yellow=Potential or Readily Correctable Problem; and Red=Failure).

Control system 100 may also comprise a reset 270. Reset 270 may be used to reset the processor 200. In one exemplary embodiment, reset 270 is a dual-mode reset. In this embodiment, dual-mode reset 270 can reset the processor 200 by temporarily removing electrical power from the processor 200 to allow it to power down and then restarting the processor, or by reinitializing or reprogramming the processor 200 (e.g., to a default state). The processor 200 may be automatically reset (e.g., based on a time-out condition) or manually reset by the user (e.g., by pressing a button). In addition, reset 270 may also send an identification signal (e.g., to the bridge 155, a network server) which identifies the control system 100 as a device on the network 110.

Watchdog timer 260 and reset 270 circuits are described in co-pending, co-owned U.S. patent application entitled "GLOBAL AND LOCAL RESET CIRCUITS FOR NETWORK DEVICES" of Adamson, et al., filed on the same date as the present patent application Ser. No. 10/631,599. Other watchdog timer 260 and reset 270 circuits are commercially available and may be readily provided for use with the processor 200 by one skilled in the art after having become familiar with the teachings of the present invention. Although watchdog timer 260 and reset 270 are preferably provided external to the processor 200 and are therefore unaffected by failure of the processor itself, in other embodiments, watchdog timer 260 and reset 270 may be provided as part of the processor 200 itself either in addition to external watchdog timers and resets or in place thereof.

Program code 220 may be provided in computer-readable storage operatively associated with processor 200 for generating output signals in response to receiving control signal (s) via line 210 (e.g., issued by input device 120 over the network 110).

According to one embodiment, program code 220 may comprise scripts. Scripts are computer-readable program code optimized for programmer efficiency (e.g., it is relatively easy to write, flexible, and readily modified). Scripts are preferably independent of the type of processor and/or operating system and are therefore portable to a variety of different environments. Among other advantages, scripts may also comprise predefined, high-level routines, such as string manipulation operators, regular expressions, and associative arrays.

Embodiments for controlling a device using scripts is described in co-pending, co-owned U.S. patent application entitled "DISTRIBUTED CONTROL SYSTEMS AND METHODS FOR BUILDING AUTOMATION" of Hesse, et al., filed on Apr. 24, 2003 (Ser. No. 10/422,525), which is hereby incorporated herein by reference for all that it discloses. The scripts may be defined based on various parameters, such as the needs and desires of the building occupant. The scripts can also be reconfigured based on the changing needs and/or desires of the building occupants.

It is to be understood, however, that control system 100 of the present invention is not limited to use with scripts. Any suitable program code may be provided for use with the present invention. Other exemplary embodiments of program code 220 may comprise firmware, compiled languages, object-oriented programming languages, to name only a few.

In any event, program code 220 preferably comprises instructions corresponding to the control signals that are received at control system 100 (e.g., from input device 120). The processor 200 executes the program code 220 and generates one or more output signals 230 (e.g., DATA, CLK, OFF) according to the executed instructions.

In one embodiment, data stream from the processor 200 may comprise digital output signals 230 such as DATA signal 231. DATA signal 231 may have an address component (e.g., Zone 1, Zone 2, etc.) and an output configuration component (e.g., lighting intensity, slew rate). The address component may be used to identify which regulator 130 is being configured, and even which light(s) 140 are being controlled by the output configuration component. According to one embodiment, output signals may also comprise one or more optional OFF signals 232–234. The OFF signal 232 may be used to configure the regulator 130 to shut off the lights 140, as will be described in more detail below with regard to one embodiment of interface 250. A clock (or "CLK") signal 235 may also be provided by the processor 200 for synchronous delivery of the output signals 230.

It is understood, however, output from the processor 200 is not limited to DATA signals 231, OFF signals 232–234, and CLK signals 235. By way of example, processor 200 may operate according to any of a wide variety of serial (e.g., SPI, $I^2C$) or parallel protocols, as will be readily appreciated by those skilled in the art upon understanding the teachings of the present invention.

The output signals are delivered via an interface 250 to the regulator 130 for configuring the regulator 130, which in turn controls the lighting. For example, the regulator 130 may be configured to slew the lights 140 on over thirty seconds to a lighting intensity of 50%.

As briefly described above, control system 100 may comprise interface 250, which formats output from the processor 200 for use by regulator 130. Accordingly, control system 100 may be used with any of a wide variety of regulators 130 that operate according to different control protocols. By way of example, interface 250 may convert digital output signals 230 to DC voltage signals (e.g., 0 to 10 volts DC), DC current signals, pulse-width modulated (PWM) signals, line voltage carrier signals, radio frequency (RF) signals, and signals for proprietary controller protocols (e.g., LON WORKS, CE Bus), or even digital signals.

If control system 100 can be used with more than one type of regulator 130, processor 200 is preferably provided with cross-reference capability, such as look-up table (LUT) 225 which identifies the different types of regulators 130 connected to interface 250 and defines output for processor 200 corresponding to the different types of regulators 130.

The following is provided as illustrative of different regulators 130 that may be used with control system 100 of the present invention. The Osram Sylvania regulator (see above) operates on an analog voltage scale of about 1 to 6 volts. For example, on one end of the scale an analog voltage signal of 1 volt may correspond to a 10% lighting intensity and on the other end of the scale an analog voltage signal of 6 volts may correspond to a 100% lighting intensity.

As another example, the Easylite regulator (see above) operates on a reverse polarity analog voltage scale of about 1.8 to 8.8 volts. On one end of the scale, an analog voltage signal of 1.8 volt may correspond to a 100% lighting intensity and on the other end of the scale an analog voltage signal of 8.8 volts may correspond to a 10% lighting intensity. An analog voltage signal of 12 volts corresponds to a 0% lighting intensity, or a shut-off condition.

In either embodiment, interface 250 may be provided to convert the digital output signals 230 from the processor 200 to analog voltage signals or analog current signals for use by regulator 130. In addition, program code (e.g., firmware) may be provided for processor 200 for switching between voltage control or current control modes of operation so that the same control system 100 can be used to operate different types of regulators 130. Indeed, the program code may configure the same interface 250 to control more than one type of regulator 130 (e.g., for different Zones 1–n).

Figure 3:
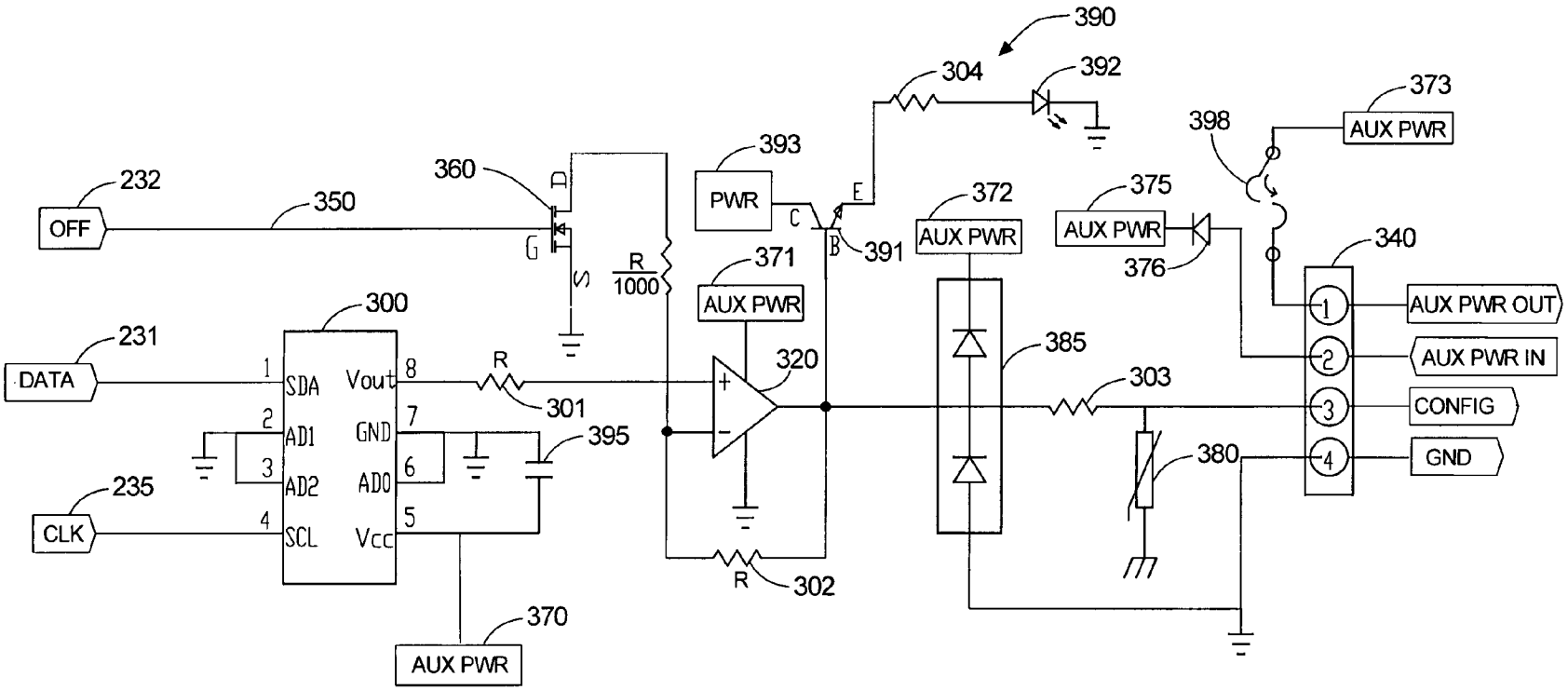
FIG. 3 is a circuit diagram showing one embodiment of an interface circuit for the control system.

Circuitry for one embodiment of interface 250 is shown in more detail in FIG. 3. It is understood that the circuitry can be replicated to accommodate a plurality of regulators 130 (e.g., Zone 1 through Zone n). It is also understood that interface 250 may be provided for spatially distributed zones. For example, zones may be distributed in different rooms or even on different floors of a building.

Advantageously, the embodiment of interface 250 shown in FIG. 3 may be used with a number of different types of regulators 130. For example, this embodiment of interface 250 may be used to convert digital output signals 230 to analog voltage configuration signals in the range of 1 to 6 volts for Osram Sylvania regulators. This embodiment of interface 250 may be also used to convert digital output signals 230 to analog voltage configuration signals in the range of 1.8 to 12 volts for Easylite regulators. In addition, this embodiment of interface 250 also accommodates the shut-off condition provided by the Easylite regulators, as will be described in more detail below.

As shown in FIG. 3, interface 250 may comprise a digital to analog converter (D/A converter) 300. The D/A converter 300 receives digital data signals 231 and clock signals 235 from the processor 200 and outputs corresponding analog voltage signals. Analog voltage signal is delivered to operational amplifier (op amp) 320. Resistors 301 and 302 may be provided to set the gain of op amp 320. Op amp 320 increases the gain of the analog voltage signal (e.g., from 0–5 volts to 0–10 volts) resulting in greater granularity for configuring the regulator 130. A wider signal spread allows the regulator 130 to "fine tune" or adjust in smaller increments the lighting intensity of lights 140 (e.g., 1% illumination intervals or better).

The amplified analog voltage signal is delivered to the regulator 130. In one embodiment, the amplified analog voltage signal is provided to a connector 340 (e.g., shown at pin 3). Connector 340 may be linked to mating connectors provided on regulator 130 to simplify installation.

Amplified analog voltage signal at pin 3 on connector 340 preferably corresponds to a configuration for regulator 130. In preferred embodiments, the circuitry shown and described with regard to FIG. 3 may be used with a number of different types of regulators 130. By way of example, the Osram Sylvania regulator may use an analog voltage signal of 1 volt to adjust output from the lights 140 to an intensity of about 10%.

Some types of regulators 130 can be operated to shut off the lights 140. For example, a voltage signal of about 12 volts corresponds to an off condition in Easylite regulators. The embodiment of interface 250 shown in FIG. 3 also provides support for this feature. More specifically, processor 200 may hold line 350 low (or a digital "0") during operation of the lighting. The processor 200 may set line 350 high (or a digital "1") to turn off the lighting. When the processor returns line 350 to low, the configuration signal is returned to the present configuration defined by the DATA signal (e.g., 10% illumination), and the lights are returned to the desired illumination level (e.g., 10%).

In one embodiment, when line 350 is set high, the gate of field effect transistor (FET) 360 is pulled up, changing op amp 320 from a linear device producing a low gain (e.g., ×2) to a comparator with a theoretically infinite gain (e.g., ×1001). Accordingly, op amp 320 increases the signal gain (e.g., to 12 volts) for delivery to the regulator 130. The regulator 130 shuts off the lights 140 in response to receiving the 12 volt configuration signal. When line 350 is returned to a low state (e.g., by default), op amp 320 returns to its state as a linear device producing a low gain for configuring the regulator 130 as previously described.

Electrical power may be provided to the interface 250 according to any of a number of different embodiments and combinations thereof. For example, electrical power may be provided by the main power source (e.g., via line 215 in FIG. 2) and/or an auxiliary source as previously described.

In addition, the circuitry shown in FIG. 3 also illustrates one embodiment for providing an auxiliary power source 375 for control system 100. According to this embodiment, electrical power provided at regulator 130 and/or lights 140 may be tapped to provide auxiliary power source 375. A line-in at pin 2 on connector 340 may be provided from the regulator 130 and/or lights 140 to the auxiliary power supply 375. Diode 376 may be provided to control the direction of current flow into the auxiliary power source 375. Auxiliary power source 375 may be used to feed electrical power to the interface 250 (e.g., via line 281 and regulator 280 in FIG. 2).

In the embodiment shown in FIG. 3, electrical power is provided to the D/A converter 300 (e.g., at 370). An optional bypass capacitor 395 may be provided to clean the auxiliary power signal. Auxiliary power that is independent of the electrical power provided to the processor 200 enables the D/A converter 300 to continue generating output based on the most recent data signal received from the processor 200, even if the processor 200 fails. Accordingly, the lights 140 will remain at the desired intensity and the user does not violate power usage agreements with the utility company or suffer disruption at the facility.

In addition, electrical power may be provided as backup to the regulator 130, and in turn, to the lights 140 from auxiliary power source 373 via pin 1 on connector 340. In-line fuse 398 may also be provided to protect the regulator 130. Accordingly, even if the main electrical power supply fails and auxiliary power at pin 1 is still on, the interface 250, regulators 130, and lights 140 continue to receive electrical power for operation.

Interface 250 may also be provided with surge protection. According to one embodiment, a metal oxide varistor (MOV) 380 may be provided to shunt the surge to the chassis (i.e., ground). MOV 380 protects the circuit against common mode signals. Resistor 303 may be provided to further protect op amp 320 by limiting current if the MOV is overloaded. The ground line (pin 4 on connector 340) to regulator 130 may also be provided with surge protection to protect the circuit from differential line signals. For example, diodes 385 may be connected in series to the auxiliary power source 372 and are connected to the filter capacitors which go to ground (device 340, pin 4) to absorb the differential line signals.

Interface 250 may also be provided with a status indicator 390. Status indicator 390 may comprise a bi-polar junction transistor (BJT) 391 and light-emitting diode (LED) 392. Resistor 304 may be provided to limit current and control the brightness of LED. The base of BJT 392 is connected to the output of op amp 320. Electrical power is provided at 393 (e.g., from main power source). LED 392 is representative of the output from op amp 320 by changing from dim to bright or vice versa. For example, the LED 392 will be dim in response to a low voltage output at op amp 320 (corresponding to the lights on the Osram Sylvania regulator being dimmed). The LED 392 will be bright in response to a high voltage output at op amp 320 (corresponding to the lights on the Osram Sylvania regulator being raised). Alternatively, the LED 392 will be bright in response to a high voltage output at op amp 320 (corresponding to the lights on the Easylite regulator being dimmed). The LED 392 will be dim in response to a low voltage output at op amp 320 (corresponding to the lights on the Easylite regulator being raised). Of course, the circuit can be readily modified so that the LED 392 will be dim in response to a high voltage output and bright in response to a low voltage output.

Having described one embodiment of an interface 250 that may be used according to the teachings of the invention, it is understood that other embodiments are also contemplated as being within the scope of the invention. For purposes of illustration, other embodiments of interface 250 may comprise a multiplexer (MUX) for regulators 130 operable with digital signals, a voltage control oscillator (VCO) or pulse-width modulator (PWM) for regulators 130 operable with analog square wave signals, to name only a few. Other embodiments for interface circuitry will also occur to those skilled in the art after having become familiar with the teachings of the present invention. In still other embodiments, the functions of interface 250 may be provided by the processor 200 and separate circuitry need not be provided.

It is also understood that interface 250 may comprise circuitry specific to one type of regulator, or circuitry can be provided for use with a plurality of different types of regulators 130, such as in the embodiment described above. By way of further example, the circuitry for interface 250 shown in FIG. 3 may also comprise a multiplexer (MUX).

Control system 100 may be operated to configure at least one regulator 130 to control one or more lights 140 according to an embodiment of the invention as follows. Input device 120 may issue a control signal over network 110 for control system 100. For example, the input device 120 may be a keypad and the control signal is generated when a user presses a key or series of keys on the keypad to dim the lighting to 10% intensity. In another example, monitor 170 may issue a control signal to the control system 100 to turn off or turn down the lighting during daylight hours.

As yet another example, the keypad may notify the monitor 170 of the desired intensity level and also issue a control signal to the control system 100 to adjust the lighting to the desired intensity level. When the control system 100 adjusts the lighting to the desired intensity level, monitor 170 may determine whether the actual output of the lights 140 is about equal to the desired lighting intensity indicated by the keypad. If the actual output of the lights 140 is not within a predetermined range (e.g., ±5 lumens), the monitor 170 may provide feedback to the control system 100, which the control system can use to adjust the lighting intensity. Alternatively, monitor 170 may issue a control signal to the control system 100 to increase or decrease the lighting intensity (e.g., by 20%) based on the actual output of the lights 140 or overall lighting in the room.

Advantageously, these embodiments allow the predetermined lighting level to be maintained in the room even as the lights 140 age and experience lumen depreciation (i.e., decreased lighting output). Such embodiments are also advantageous, for example, where the user wants to control the overall light intensity in a room that includes lighting from other sources (e.g., sunlight, other lighting circuits) and not just the intensity level of the lights 140 themselves.

In these examples, the control signal may comprise data identifying the key(s) that were pressed on the keypad 120 or feedback from the monitor 170. Upon receiving this control signal at control system 100, processor 200 executes program code 220. The program code 220 may comprise instructions corresponding to the control signal and preferably defines parameters (e.g., slew rate or intensity) for configuring the regulator 130 to control the lights 140.

In response to executing the program code 220, the processor 200 generates output signals 230, which may be delivered to interface 250. Interface 250 converts the output signals 230 from processor 200 to configuration signals for use by the regulator 130, as explained above with regard to the embodiment shown in FIG. 3. The configuration signals configure the regulator 130 to control output from the lights 140.

It is readily apparent that control system 100 of the present invention represents an important development in the field of regulators in general, and more particularly to control in a network environment. Having herein set forth preferred embodiments of the present invention, it is expected that suitable modifications can be made thereto which will nonetheless remain within the scope of the present invention.

What is claimed is:

1. A method for controlling at least one regulator, comprising:

receiving control signals at a processor;

generating output signals at the processor based on the control signals;

configuring the at least one regulator based on the output signals; and maintaining the output of the at least one regulator in the event of a power source failure.

2. The method of claim 1, further comprising addressing the output signals to the at least one regulator.

3. The method of claim 1, further comprising shutting off a load operatively associated with the at least one regulator.

4. The method of claim 1, wherein configuring the at least one regulator is based on analog signals.

5. The method of claim 1, wherein configuring the at least one regulator is based on digital signals.

6. The method of claim 1, further comprising providing at least one auxiliary power source for configuring the at least one regulator.

7. A control system, comprising:

a processor for receiving control signals from at least one input device when linked thereto;

computer-readable program code for generating output signals at said processor based on the control signals; and an interface operatively associated with said processor, said interface configuring at least one regulator based on the output signals generated at said processor by delivering pulse width modulated signals to the at least one regulator.

8. The control system of claim 7, wherein said processor is linked to said at least one input device via a CAN bus.

9. The control system of claim 7, wherein said computer-readable program code comprises at least one script.

10. The control system of claim 7, wherein said output signals generated at said processor comprise at least a data component and an address component.

11. The control system of claim 7, wherein said output signals generated at said processor comprise a shutoff signal.

12. The control system of claim 7, wherein the regulator controls at least one gas discharge lamp.

13. The control system of claim 7, wherein said interface converts the output signals generated by said processor to analog voltage signals.

14. The control system of claim 7, wherein said interface converts the output signals generated by said processor to current signals.

15. The control system of claim 7, further comprising program code for converting said interface between voltage-control and current-control modes.

16. The control system of claim 7, wherein said interface configures the at least one regulator by delivering digital signals to the at least one regulator.

17. The control system of claim 7, further comprising at least one auxiliary power source for providing electrical power to said interface.

18. The control system of claim 7, further comprising an external watchdog timer operatively associated with said processor, said watchdog timer indicating the operational status of said processor.

19. The control system of claim 7, further comprising a dual-mode reset circuit operatively associated with said processor, said reset circuit for resetting said processor.

20. The control system of claim 7, wherein said interface supports a plurality of different types of regulators.

21. The control system of claim 7, wherein said interface further comprises:

a digital to analog converter;

an operational amplifier operatively associated with said digital to analog converter, said operational amplifier increasing control granularity of the at least one regulator.

22. The control system of claim 21, wherein said interface further comprises a field effect transistor operatively associated with said operational amplifier, said field effect transistor changing the functionality of said operational amplifier to a comparator when the processor issues an OFF signal.

23. The control system of claim 21, wherein said interface further comprises a light-emitting diode operatively associated with said field effect transistor, said light-emitting diode indicating the operational status of said interface.

24. A control system, comprising:

a processor for receiving control signals from at least one input device when linked thereto;

computer-readable program code for generating output signals at said processor based on the control signals; and an interface operatively associated with said processor, said interface configuring at least one regulator based an the output signals generated at said processor, wherein said interface comprises a digital to analog converter and an operational amplifier operatively associated with said digital to analog converter, said operational amplifier increasing control granularity of the at least one regulator.

25. The control system of claim 24, wherein said interface further comprises a field effect transistor operatively associated with said operational amplifier, said field effect transistor changing the functionality of said operational amplifier to a comparator when the processor issues an OFF signal.

26. The control system of claim 24, wherein said interface further comprises a light-emitting diode operatively associated with said field effect transistor, said light-emitting diode indicating the operational status of said interface.

27. A control system, comprising:

a processor for receiving control signals from at least one input device when linked thereto;

computer-readable program code for generating output signals at said processor based on the control signals;

an interface operatively associated with said processor, said interface configuring at least one regulator based on the output signals generated at said processor; and program code for converting said interface between voltage-control and current-control modes.

28. A control system, comprising:

a processor for receiving control signals from at least one input device when linked thereto;

computer-readable program code for generating output signals at said processor based on the control signals;

an interface operatively associated with said processor, said interface configuring at least one regulator based on the output signals generated at said processor; and a dual-mode reset circuit operatively associated with said processor, said reset circuit for resetting said processor.

* * * * *